US011371664B2

(12) United States Patent
Lin et al.

(10) Patent No.: US 11,371,664 B2
(45) Date of Patent: Jun. 28, 2022

(54) LED LAMP WITH A CONNECTION MODULE WITH AN ANTENNA FUNCTION

(71) Applicant: LEDVANCE GmbH, Garching bei Munich (CN)

(72) Inventors: Jing Lin, Shenzhen (CN); Wuqiang Liao, Shenzhen (CN); Linglin Tan, Shenzhen (CN); Junshen Zhang, Shenzhen (CN); Xiongqiang He, Shenzhen (CN)

(73) Assignee: LED VANCE GMBH, Garching bei Munchen (DE)

( * ) Notice: Subject to any disclaimer, the term of this patent is extended or adjusted under 35 U.S.C. 154(b) by 0 days.

(21) Appl. No.: 16/787,139

(22) Filed: Feb. 11, 2020

(65) Prior Publication Data

US 2020/0256520 A1 Aug. 13, 2020

(30) Foreign Application Priority Data

Feb. 11, 2019 (CN) ..... 201920189713.5

(51) Int. Cl.

| | |
|---|---|
| ***H01Q 1/38*** | (2006.01) |
| ***H01Q 1/44*** | (2006.01) |
| ***F21V 23/04*** | (2006.01) |
| ***F21K 9/238*** | (2016.01) |
| *F21Y 115/10* | (2016.01) |

(52) U.S. Cl.

CPC ..... *F21K 9/238* (2016.08); *F21V 23/0435* (2013.01); *H01Q 1/38* (2013.01); *H01Q 1/44* (2013.01); *F21Y 2115/10* (2016.08)

(58) Field of Classification Search

CPC ..... H05B 45/10; H05B 47/00; H01Q 1/38; H01Q 1/44; F21K 9/238; F21K 9/20; F21K 9/23; F21K 9/232; F21K 9/235; F21V 23/0435; F21Y 2115/10

See application file for complete search history.

(56) References Cited

U.S. PATENT DOCUMENTS

| | | | | |
|---|---|---|---|---|
| 2013/0136454 | A1* | 5/2013 | Yu | H05B 45/00 398/106 |
| 2015/0103515 | A1* | 4/2015 | Bosua | H05B 45/48 362/373 |
| 2017/0059095 | A1* | 3/2017 | Van Bommel | F21K 9/90 |

* cited by examiner

*Primary Examiner* — Jimmy T Vu

(74) *Attorney, Agent, or Firm* — Hayes Soloway PC

(57) ABSTRACT

A connection module for a lamp, preferably an LED-based filament lamp, having an on-board antenna, a driver for supporting such connection module, and a corresponding lamp having such connection module. Accordingly, a connection module for a lamp having a bulb and a base is suggested, preferably for an LED-based filament lamp, including a first side configured to be received by a driver in the base of the lamp and a second side including an elongate region extending towards the bulb of the lamp. The elongate region has a width smaller than a length of the second side and first side, and an antenna. The antenna is integrated in the connection module on the elongate region.

20 Claims, 3 Drawing Sheets

LED LAMP WITH A CONNECTION MODULE WITH AN ANTENNA FUNCTION

CROSS-REFERENCE TO RELATED APPLICATIONS AND PRIORITY

This patent application claims priority from CN Patent Application No. 201920189713.5 filed Feb. 11, 2019, which is herein incorporated by reference in its entirety.

TECHNICAL FIELD

The present invention relates to a connection module for a lamp, preferably an LED-based filament lamp, having an improved radio frequency antenna, a driver for supporting or holding such connection module, and a corresponding lamp comprising such connection module.

BACKGROUND

In existing lamp designs the space for a driver and a connection module to implement LED-based lighting is generally limited. For example, for classic filament lamps, generally glass bulbs and metal bases are used, wherein the base of the lamp provides a limited space for accommodating e.g. a driver required for the implementation of an LED-based light source. Although such space may be sufficient for the driver itself, problems arise with regard to the connection to the light source comprised within the bulb and when further functions are to be implemented such as wireless connectivity.

In such cases, a radio frequency antenna is required. However, to provide an acceptable radio frequency performance the antenna is required to stand out of the metal base, since metal parts may generally interfere with the radio signals and hence block the wireless signal transmission.

Furthermore, both the space within an inner holder of the bulb and within the base of the lamp is generally narrow, such that common solutions either include the implementation of an adaptor ring, e.g. a plastic housing, to extend the space provided by the base, both for the connection module and the antenna, or by providing a separate antenna.

In the former case, this results in a less appealing appearance and reduced acceptance of new LED-based lamps while at the same time increasing the production costs and reducing the robustness or reliability due to the increasing number of parts. In the latter case, a separate antenna needs to be manually soldered to the connection module or driver and the positioning or alignment of such antenna is often difficult when connecting the lamp parts, in particular when positioning the connection module and the antenna. Furthermore, this reduces the radio frequency performance consistency.

Accordingly, a need exists to further improve the wireless connectivity of lamps taking the above problems into account.

SUMMARY OF THE INVENTION

In view of the known prior art, it is an object of the present invention to provide an improved antenna function in lamps, in particular in LED-based filaments lamps.

This object is solved by a connection module, a driver, and a lamp according to the independent claims. Preferred embodiments are given by the dependent claims.

Accordingly, a connection module for a lamp having a bulb and a base is suggested, comprising a first side configured to be received by a connection module comprised in the base of the lamp, a second side comprising an elongate region extending towards the bulb of the lamp, wherein the elongate region has a width smaller than a length of the second side and first side, and an antenna. According to the invention, the antenna is integrated in the connection module on the elongate region. The elongate region hence forms a portion of the connection module, wherein the substrate of the connection module may provide a support for various electronic components that may together form a circuitry via e.g. electrically conductive paths. The connection module may e.g. be connected to a light engine comprising one or more light emitting diodes or LED chips. Accordingly, the elongate region forms an integral part, such that the connection module and the elongate region thereof are formed from a single part.

Such arrangement has the advantage that the manufacturing of the connection module and the antenna may be significantly facilitated since the antenna does not require any manual soldering steps, thereby enabling an automated production of the connection module comprising the antenna. For example, the connection module having the on-board antenna may be provided by means of die-cutting, stamping, or punching.

Furthermore, having the antenna integrated on the elongate region has the advantage that the radio frequency performance of the antenna is improved and consistent among each of a plurality of connection modules, since the orientation of the antenna is predefined and the connection between the antenna and the connection module is provided on the substrate of the connection module and is not dependent on the efficacy of e.g. a manual soldering step. Accordingly, the wireless connectivity function of the lamp is significantly improved. By means of the antenna, a light source of the lamp may be switched or controlled, e.g. via a remote control device coupled to the lamp via the provided wireless communication.

The width of the elongate region is to be understood as a length traversing the elongate region in a direction essentially perpendicular to an extending direction of the elongate region and at the same time being essentially perpendicular to a direction corresponding to a thickness of the substrate of the driver. For example, the width may provided as a length of the elongate region or second side being essentially parallel to the second side and at the point where the elongate region originates from the second side, e.g. at an end surface of the second side.

Furthermore, the first side of the connection module that is to be received by a driver is not required to be fully supported or held by the driver. For example, the first side may be non-linear or curved and/or may comprise one or more steps or shoulder regions, such that only a part of the first side may be received by the driver. The first side may e.g. be formed having an essentially straight end surface, which may be truncated, beveled, or chamfered, such that the connection module as a whole essentially forms a trapezoid or truncated shape rather than a rectangular or squared shape. However, the first side and second side of the connection module may generally comprise any shape and may hence be adapted to the driver and/or other components of the lamp, e.g. an inner holder of the lamp.

Preferably, the connection module is configured for an LED-based filament lamp. Accordingly, the connection module may be configured to provide an electrical connection with e.g. a light engine or, generally, with one or more light emitting diodes or LEDs. For example, the connection module may be configured as a connection module for a plurality of filaments comprising LED chips and arranged in a circumferential manner, e.g. at equal distance of each other, within a bulb of the lamp and to be placed on and/or inserted into an inner holder of the lamp. However, the connection module is not to be considered as being limited to such LED-based filament lamp and may e.g. be configured for any classical lamp type, e.g. having a base according to the E27 or E14 standard.

The provision of the antenna on the elongate region furthermore provides that an elongation of a base, e.g. using a plastic extension of the base that is adapted to receive the antenna is not required. Accordingly, this provides a much more appealing appearance, in particular for filament lamps providing a more vintage appearance, as the plastic extension may be omitted. In addition, the omission of such plastic extension significantly facilitates the manufacturing of the lamp while at the same time reducing the production costs.

Preferably, the extending direction of the elongate region essentially corresponds to a longitudinal direction of the lamp.

For example, the connection module may be generally orientated within the plane of the longitudinal direction of the lamp, i.e. a longitudinal axis extending through a center point of the base and light bulb, yet at an angle with regard to the longitudinal direction. The elongate region, however, is preferably orientated along the longitudinal direction. Accordingly, the elongate region may extend at an angle to e.g. the second side. However, preferably, the connection module as whole is oriented along the longitudinal direction of the lamp, such that the elongate region may e.g. be arranged in plane with an extending direction between the first side and second side and/or be arranged perpendicular to the first side and/or second side.

Such arrangement has the advantage that the antenna may protrude at least partially, preferably completely, into the bulb of the lamp and out of the base of the lamp, thereby improving the radio frequency characteristics of the antenna and hence the wireless connectivity function of the lamp. Furthermore, this facilitates the positioning of the driver with regard to e.g. the bulb of the lamp and/or an inner holder thereof and reduces the amount of space taken by the elongate region.

The elongate region may furthermore be provided at any position of the second side of the connection module, depending on the bulb characteristics and the components contained therein. For example, the elongate region may be provided at an end surface of the second side, e.g. at a corner or proximate to a corner, or may also be provided centrally or at a mid-section of the second side.

To further improve the radio frequency characteristics of the antenna and to further facilitate the manufacturing of the connection module, the antenna may be linearly arranged on the elongate region. Furthermore, the antenna is preferably made of copper. Thereby, the conducting and receiving performance may be further improved and the antenna may be simply applied onto the substrate of the connection module, e.g. by printing and/or etching techniques.

Preferably, a ratio of the width of the elongate region and the length of the first side and/or second side lies between 1:20 and 1:1, preferably between 1:4 and 1:6.

The elongate region hence forms a portion that is relatively thin with respect to the general surface of the substrate of the connection module. This provides that the antenna does not occupy unnecessary space within the lamp, such that the design of the lamp may be compact and the lighting characteristics or the lighting performance are not or only negligibly affected. The width of the elongate region may hence be chosen such that a sufficient support for the antenna may be provided and to provide a required amount of stability to provide a necessary robustness of the connection module and the antenna. In addition, a larger width may be provided to e.g. increase the width of the antenna and/or to provide a supporting structure for e.g. an inner holder of the bulb.

In addition, or alternatively, a ratio of a length of the elongate region extending from the second side and a length of the connection module between the first side and the second side may optionally lie between 1:20 and 5:1 or 1:1, preferably between 1:1.2 and 1.2:1.

For example, the length of the elongate region may essentially correspond to the length of the connection module between the first side and the second side, such that the ratio is about 1:1. However, the elongate region may in comparison also be larger, e.g. when the connection module is dimensioned for lamps with limited space within the cavity of a base or of a bulb, e.g. for light engines or one or more LEDs with a reduced complexity of the connection module. Furthermore, the lamp may require further improved radio frequency characteristics of the antenna, such that the corresponding elongate region may be accordingly dimensioned. By the same token, more complex connection module may require a larger substrate, such that the elongate region may be smaller compared with the rest of the surface of the connection module. In addition, the space to accommodate the antenna may be limited, such that also in the case of a standard size a length of the elongate region may be shorter than the rest of the surface of the connection module.

The connection module and, in particular, the elongate region hence may have a variety of arrangements and dimensions. Accordingly, the connection module may be adapted to various requirements. Hence, the elongate region may be dimensioned to be accommodated in a recess of a holder of the bulb, preferably a glass holder of the bulb.

Such recess may e.g. be provided in an inner glass holder, which is configured to receive e.g. a light engine or a structure comprising one or more LED filaments. Accordingly, a recess may be provided e.g. between a glass portion providing a guiding surface for the holder and/or an electrical isolation for electronic connection elements and a supporting surface for said holder, which may e.g. be dome shaped or have a conical shape. As such space is generally limited in existing lamps, the elongate region may hence be adapted to said space. Accordingly, the elongate region has the advantage that the antenna, which is provided thereon, may extend into the bulb of the lamp, which would not be possible with the larger width of the second side of the connection module.

Furthermore, a relatively small dimensioning of the connection module and/or the elongate region has the advantage that this component may be less dominant and hence less visible in e.g. a lamp, wherein a housing or holder is made of an essentially transparent material. This results in an increased acceptance for users, as the aesthetic appearance is not significantly affected.

Preferably, the connection module is made of PCB material. Accordingly, the substrate of the connection module may comprise a circuitry comprising a plurality of conducting paths and electronic elements on a substrate to form a main body of the driver. The PCB material may have a sheet like structure, such that the reduced thickness of the connection module allows a further compact design of the connection module and the elongate region. The antenna hence forms an on-board PCB antenna. Forming the connection module out of PCB material has the advantage that it can be formed out of the same material as a driver to be coupled to the connection module, thereby further facilitating the manufacturing. Alternatively, the connection module may also be formed essentially of a plastics materials or metal.

According to another aspect of the invention a corresponding driver for a lamp having a bulb and a base is suggested, preferably for an LED-based filament lamp, wherein the driver comprises a first surface to be received in a recess or cavity of the base and configured to face the base of the lamp, a second surface comprising a connecting element or support for receiving a connection module, and a connection module according to the invention, which is received by the connecting element or the support.

The driver may be formed of the same or a similar material as the substrate of the connection module, e.g. made from PCB material. Furthermore, to receive the connection module, the connecting element or support of the driver may e.g. be provided as one or more clamps or sockets that form a press-fit engagement with the connection module.

Alternatively, the driver may comprise a slit or recess extending from the first surface to the second surface through which the first side of the connection module may be inserted. The provision of the slit or recess has the advantage that the manufacturing does not require any additional steps in order to correctly place and hold the connection module in the driver. To securely hold the connection module the driver may furthermore comprise one or more protrusions, e.g. shaped as bevels or chamfers, which engage corresponding slots of the connection module to provide a snap-fit engagement, when the connection module is inserted into the driver. This allows that the combined connection module and driver may be oriented in various positions, e.g. also in an upside-down position or generally at an angle, which may further facilitate the manufacturing process.

Preferably, the elongate region of the connection module is arranged perpendicular to the second surface, wherein preferably the connection module is arranged perpendicular to the second surface.

Accordingly, the elongate region is preferably not arranged in parallel to the second surface, but is arranged at an angle with regard to the second surface, such that the elongate region may be reduced in order to extend beyond a base of the lamp. Having a perpendicular arrangement provides an efficient dimensioning as this would require a minimum length of the elongate region to extend beyond the base of the lamp. By the same token, a perpendicular arrangement of the connection module as a whole also provides that the length of the elongate region may be further reduced while at the same time the space required to receive the connection module may be reduced.

Preferably, the first surface and second surface extend in a radial direction of the lamp and/or are arranged in parallel to a center surface of the recess or cavity of the base.

Accordingly, it is preferred that the driver extends in a direction perpendicular to a longitudinal direction of the lamp, i.e. perpendicular to a vertical alignment in an upright position of the lamp. In other words, when the lamp is in an upright position, the driver is preferably arranged in a horizontal plane as this reduces the space required in the base and hence provides a more compact design of the lamp, in particular the base of the lamp.

The driver may be provided as an essentially flat surface and may e.g. comprise a rectangular form or any shape that may be adapted to the dimensioning of the recess or cavity of the base. Preferably, the driver comprises a circular surface corresponding to an inner diameter of the base, such that the driver may be placed coaxially to the base. This not only facilitates the positioning of the driver in the base and hence the manufacturing process of the lamp, but also increases the efficient use of the available space while at the same time providing better thermal conductivity, e.g. via a wall of the base.

In order to connect e.g. a light engine or other light source within the bulb of the lamp with an energy source or electrical contact of a socket or fixture, the driver preferably provides an electrical connection between the connection module and a contact pin or the base of the lamp. Accordingly, the driver may comprise various electronic components that are integrated within or attached to a surface of the connection module. Preferably, the connecting element or support of the driver also provides the electrical connection to the connection module, e.g. via one or more contact springs or spring clips. Alternatively, the connection module may be directly soldered on the driver board or may be linked freely via wires. Accordingly, the connection module and the driver may form the main electrical components for a light source, e.g. LED filaments, comprised within the bulb of the lamp.

According to another aspect of the invention a corresponding lamp, preferably an LED-based filament lamp, is suggested, which comprises a bulb, a base for providing an electrical contact with a lamp socket, and a connection module according the invention.

The bulb of the lamp is preferably a glass bulb, but may alternatively also be formed of a polymer or plastics material. Furthermore, the base of the lamp is preferably formed of metal, such that an electrical contact is provided to a lamp socket. Accordingly, the lamp may resemble a classical lamp type, e.g. having a base according to the E27 or E14 standard.

To provide an electronic connection to the connection module, the lamp preferably comprises a driver as described in the above, wherein the base comprises a recess or cavity and wherein said driver is received in the recess or cavity of the base.

Accordingly, essentially all of the electronic components required for the light source accommodated in the light bulb are comprised within the base, which not only provides an improved appearance and acceptance by potential users, but also increases the lighting characteristics as no components obstruct the light emitted from the light source.

To accommodate the light source, the bulb of the lamp furthermore may comprise a holder, preferably a glass holder, wherein the elongate part of the connection module is arranged at least partially within a recess of said holder.

The holder is preferably an inner holder, wherein the holder may be inserted into the bulb via an opening of the bulb facing the base of the lamp. This facilitates the manufacturing, since the light source may be positioned on the holder prior to insertion. However, the holder may also extend at least partially outside of the bulb, e.g. extending from said opening of the bulb into the base of the lamp. This may provide e.g. a guiding surface to facilitate the positioning of the bulb and holder with regard to the base of the lamp. The holder may e.g. provide a support for a light engine or for a structure comprising a plurality of LED filaments and may furthermore comprise one or more channels that may be used to improve the thermal conductivity and/or to provide electrically isolated channels for connectors at the driver and/or connection module.

The elongate region furthermore provides that the antenna may be provided within the recess of said holder, e.g. between a guiding surface or portion and a supporting wall of the holder. As this space is very limited, the connection module as a whole may not be fitted in said space. However, the elongate region of the connection module, e.g. a thin and small yet long part of a PCB connection module, may be inserted in said space, such that the on-board or integrated antenna may be provided in the bulb or holder without requiring any adaptations of the base or bulb, e.g. an enlargement of the base by means of a plastic adaptor ring to increase the space available for the antenna.

The particular arrangement of the connection module with regard to the driver and/or base has the advantage that the elongate region comprising the antenna may receive and/or transmit radio frequency signals from/to the ambient environment, i.e. outside of the lamp. Accordingly, the elongate region of the connection module preferably extends beyond the base in a longitudinal direction of the lamp.

This further improves the radio frequency characteristics, since the metal base does not interfere with the antenna. In other words, since the antenna is standing or in an upright position in the inner glass holder, no metal parts are blocking the wireless signal transmission, so the connecting performance of the lamp is facilitated. The longitudinal orientation hence maximizes the length of the antenna. The extension beyond the base hence omits any adaptations otherwise required, e.g. an enlargement of the base by means of a plastic adaptor ring to increase the space available for the antenna. Therefore, the manufacturing of the lamp is significantly facilitated while at the same time the reliability is improved and the production costs are reduced.

BRIEF DESCRIPTION OF THE DRAWINGS

Preferred embodiments of the invention will be explained in the following, having regard to the drawings. It is shown in.

DETAILED DESCRIPTION OF THE INVENTION

In the following, preferred embodiments of the invention will be described with reference to the drawings. The same or similar elements or elements having the same effect may be indicated by the same reference number in multiple drawings. Repeating the description of such elements may be omitted in order to prevent redundant descriptions.

Figure 1:
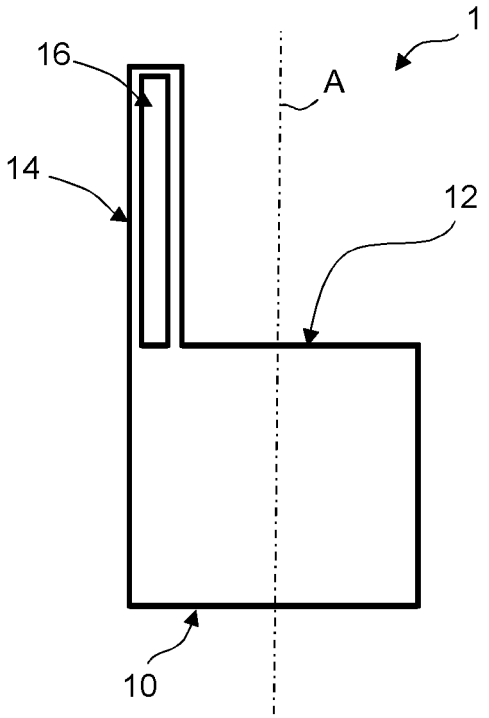
FIG. 1 a schematic depiction of a connection module having an integrated antenna on an elongate region.

In FIG. 1 a schematic depiction of a connection module 1 is shown, which is configured to connect to an LED-based light source of a lamp (not shown). The connection module 1 is positioned in an upright position, such that the connection module 1 is essentially aligned along a longitudinal direction A. Said longitudinal direction A may correspond to a longitudinal direction of an assembled lamp (not shown) in an upright position, i.e. from the bottom end of a base to the top of a bulb. Although not explicitly shown, the substrate of the connection module 1 is made of PCB material, such that various electrical components (not shown) may be provided on a main surface of the printed circuit board by means of e.g. printed electrically conducting paths.

The connection module 1 comprises a first side 10 and a second side 12, which are depicted as linear end surfaces or edges of the connection module 1. However, each of said sides may also have alternative shapes, e.g. comprising one or more steps or having a truncated or (sharply) bent angle, thereby providing e.g. a right trapezoid shape. Alternatively, other polygonal shapes, such as a triangular or pyramid shape, or an ellipsoid or circular shape of the area comprised between the first side 10 and the second side 12 are optionally also possible.

The first side 10 is configured to be received by a driver (not shown) of a lamp, to thereby be provided with an electrical connection to e.g. a pin or lead arranged in the base of the lamp and for the appropriate electrical control of a light source. Accordingly, the connection module 1 may be provided with the required energy for a light source (not shown) accommodated within a bulb of the lamp. Such light source may e.g. be connected to the connection module 1 at the second side 12 or via electrical components arranged on the surface of the connection module 1.

The second side 12 furthermore comprises an elongate region 14, which comprises an integrated antenna 16. The antenna 16 is made of copper and is arranged in a linear fashion to increase the radio frequency performance. The elongate region 14 is depicted on an end surface or corner of the connection module 1, however, may optionally also be arranged centrally or at a mid-section of the second side 12, depending on the available space in the lamp.

The elongate region 14 comprises a width smaller than a length of the second side 12 and the first side 10. Thereby, due to the thin and small dimensions, the elongate region 14 may protrude into a recess provided in a holder (not shown) of a light bulb. The connection module 1 as a whole may hence be dimensioned such that it does not extend beyond a rim or end surface of a metal base while the elongate region 14 extends beyond the metal base and is accommodated in the holder or a bottom region of the bulb.

Accordingly, an improved radio frequency performance is provided without requiring additional space within the base or requiring additional parts to be electrically connected to the connection module 1. The implementation of the elongate region 14 and the on-board integrated antenna 16 hence significantly facilitates the manufacturing and improves the wireless connectivity of an LED-base lamp.

In addition, the elongate region 14 is aligned along the longitudinal direction A and is depicted as being perpendicular to the first side 10 and the second side 12. Thereby, a maximum length of the antenna 16 is provided in the longitudinal direction A, such that the antenna 16 may sufficiently extend beyond the metal base of the lamp and provides an improved radio frequency performance. Furthermore, such alignment facilitates the positioning of the connection module 1 with regard to a light bulb or holder and requires a minimum amount of space. However, depending on the requirements, the elongate region 14 may also be aligned at an angle and may furthermore comprise a non-linear shape.

In the embodiment according to FIG. 1 the length of the elongate region 14 extending from the second side 12 and a length of the connection module 1 between the first side 10 and the second side 12 are essentially the same. Accordingly, a ratio of said lengths equals about 1:1.

Figure 2:
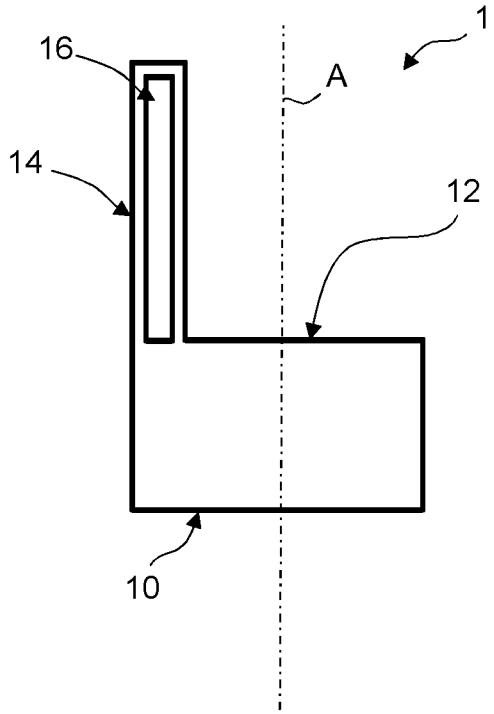
FIG. 2 a schematic depiction of a connection module according to FIG. 1 having alternative dimensions.

However, depending on the space provided in the base of the lamp and the required complexity of the connection module 1, said ratio may be different. For example, the embodiment of FIG. 2 generally corresponds to the embodiment according to FIG. 1. However, although the length of the elongate region 14 corresponds to the embodiment of FIG. 1, the length of the connection module 1 between the first side 10 and the second side 12 is about half the length, thereby providing a ratio of about 2:1. This may e.g. be advantageous in cases where a limited amount of space is available in the base of the lamp and wherein a moderate complexity of the connection module 1 is required. By retaining the length of the elongate region 14, the radio frequency performance of the lamp is however maintained.

Figure 3:
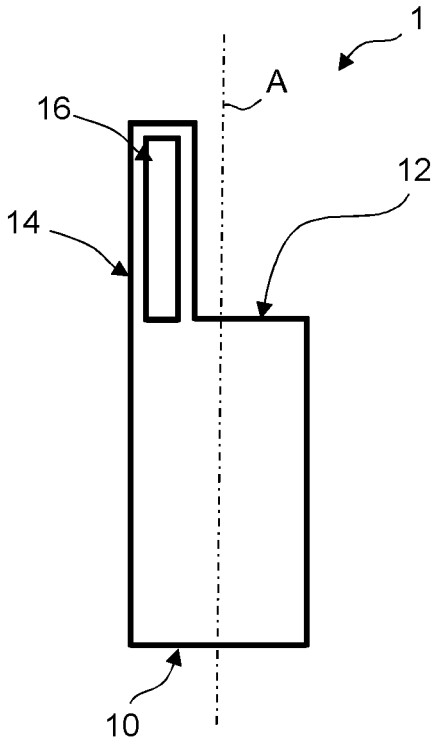
FIG. 3 a schematic depiction of a connection module according to FIG. 1 having alternative dimensions.

By the same token, FIG. 3 depicts an embodiment generally corresponding to the embodiment according to FIG. 1, wherein the length of the connection module 1 between the first side 10 and the second side 12 is maintained, but wherein the width or length of the first side 10 and the second side 12 is reduced by about half. Accordingly, a ratio of said widths is about 1:3 rather than a ratio of about 1:6 depicted in FIG. 1. Furthermore, the length of the elongate region 14 has been reduced by half, such that a ratio with regard to the length of the connection module 1 between the first side 10 and the second side 12 is about of about 1:2. This may e.g. be advantageous in cases wherein a larger base is provided, e.g. required for a larger complexity of the connection module 1, while the antenna 16 is only required for short distances and without much interference of other electronic devices.

Figure 4:
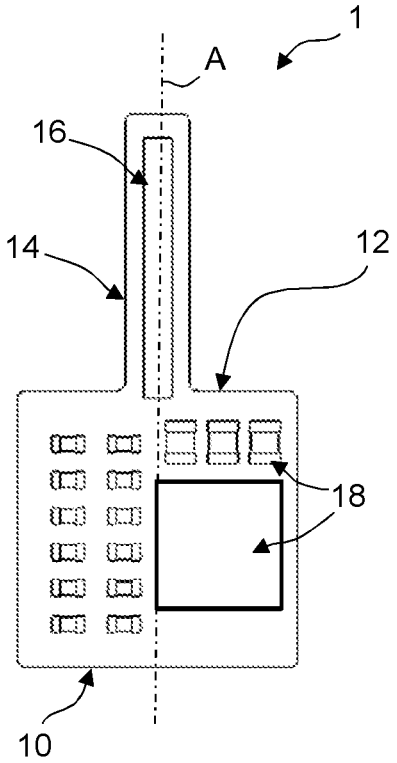
FIG. 4 a schematic depiction of a connection module according to FIG. 1 having alternative dimensions and with an alternative arrangement of the elongate part.

In FIG. 4 an embodiment of the connection module 1 is depicted that generally corresponds to the embodiment according to FIG. 1, wherein the elongate region 14 comprising the antenna 16 is arranged at a central position along the longitudinal direction A. This may further facilitate the positioning of the connection module 1 and a holder of the bulb of the lamp, e.g. by aligning the elongate region 14 adjacent to a central guiding portion of such holder. Accordingly, both the insertion of the elongate region 14 into e.g. a recess of such holder and the insertion of such holder into the base of the lamp are facilitated. In addition, the elongate region 14 may provide a support for the holder and the light source, e.g. LED filaments, arranged on the holder. Furthermore, the functionality of the connection module 1 is schematically depicted by the provision of a plurality of electronic components 18, e.g. a plurality of diodes and a chip, accommodated on a main surface of the connection module 1.

Figure 5:
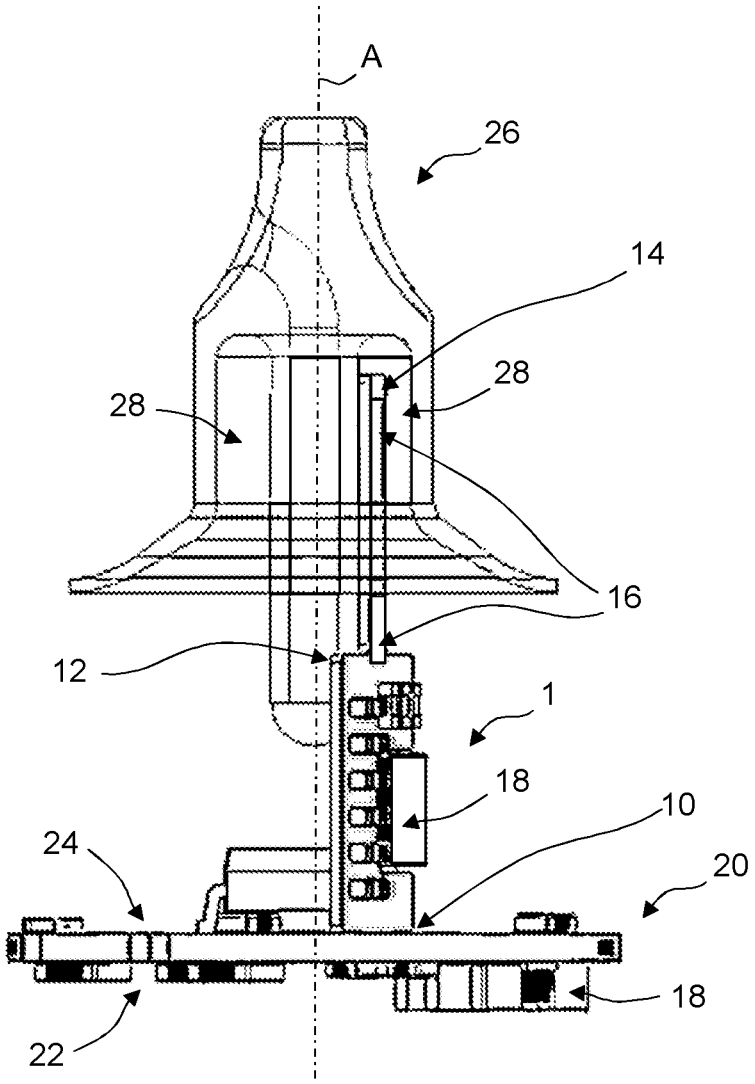
FIG. 5 a schematic depiction of a connection module received by a driver, wherein the elongate region is positioned in a holder.

In the schematic depiction of FIG. 5, the connection module 1 is furthermore shown in an assembled state together with a driver 20 and a holder 26.

The elongate region 14 comprising the antenna 16 extends from the second side 12 in a longitudinal direction A, which corresponds to a central axis or longitudinal direction of the holder 26. The elongate region 14 is inserted in a recess 28, which is provided between an outer wall and a guiding portion of the holder 26. Accordingly, the antenna 16 protrudes into the holder 26 while at the same time the dimensions of the connection module 1 need not be adapted.

For example, the length between the first side 10 and the second side 12 of the connection module 1 may be maintained and does not require any modification, e.g. a reduction in size to accommodate the elongate region 14. By the same token, the connection module 1 does not require an extension and a corresponding adaptor ring, since the antenna 16 is accommodated within the holder 26. The antenna 16 hence protrudes sufficiently outside of a metal base of the lamp (not shown).

The holder 26 may be essentially formed as an inner holder made of glass, such that an electrical isolation for a light source (not shown) and required thermal and optical characteristics are provided. The light source, e.g. a structure having a plurality of LED filaments, may hence be arranged on and/or at least partially in the holder and may be connected to the connection module 1 or the driver 20 by appropriate electrical contacts. For example, the connection module 1 comprises various electronic components 18 on a main surface and may hence be used to electrically connect the light source.

Furthermore, the driver 20 comprises various electronic components 18 and provides an electronic contact to a metal base, lead, or pin (not shown) to electrically connect the lamp with e.g. a socket. Such components may be accommodated on a first surface 22 and/or on a second surface 24. The driver 20 is furthermore configured to be received by a base of the lamp, e.g. in a recess or cavity thereof (not shown).

Accordingly, the first surface 22 is oriented to face a central surface of such cavity and hence provides a support for the connection module 1. Although a particular support is not explicitly shown, generally any means or connecting element suitable for holding and/or securing the connection module 1 may be provided. Preferably, such attachment is provided by means of one or more clamps or by means of a snap-fit engagement. Such snap-fit engagement may be provided by one or more protrusions around a slit or through hole or opening extending from the first surface 22 to the second surface 24, wherein said protrusions engage corresponding slots on the connection module 1, when the connection module 1 is inserted in the slit. To facilitate the insertion, the one or more protrusions may comprise a beveled surface or chamfer to guide the connection module 1. Aside from the improved radio frequency performance, the manufacturing is hence also facilitated, since the connection module 1 may be simply inserted into the driver 20.

Figure 6:
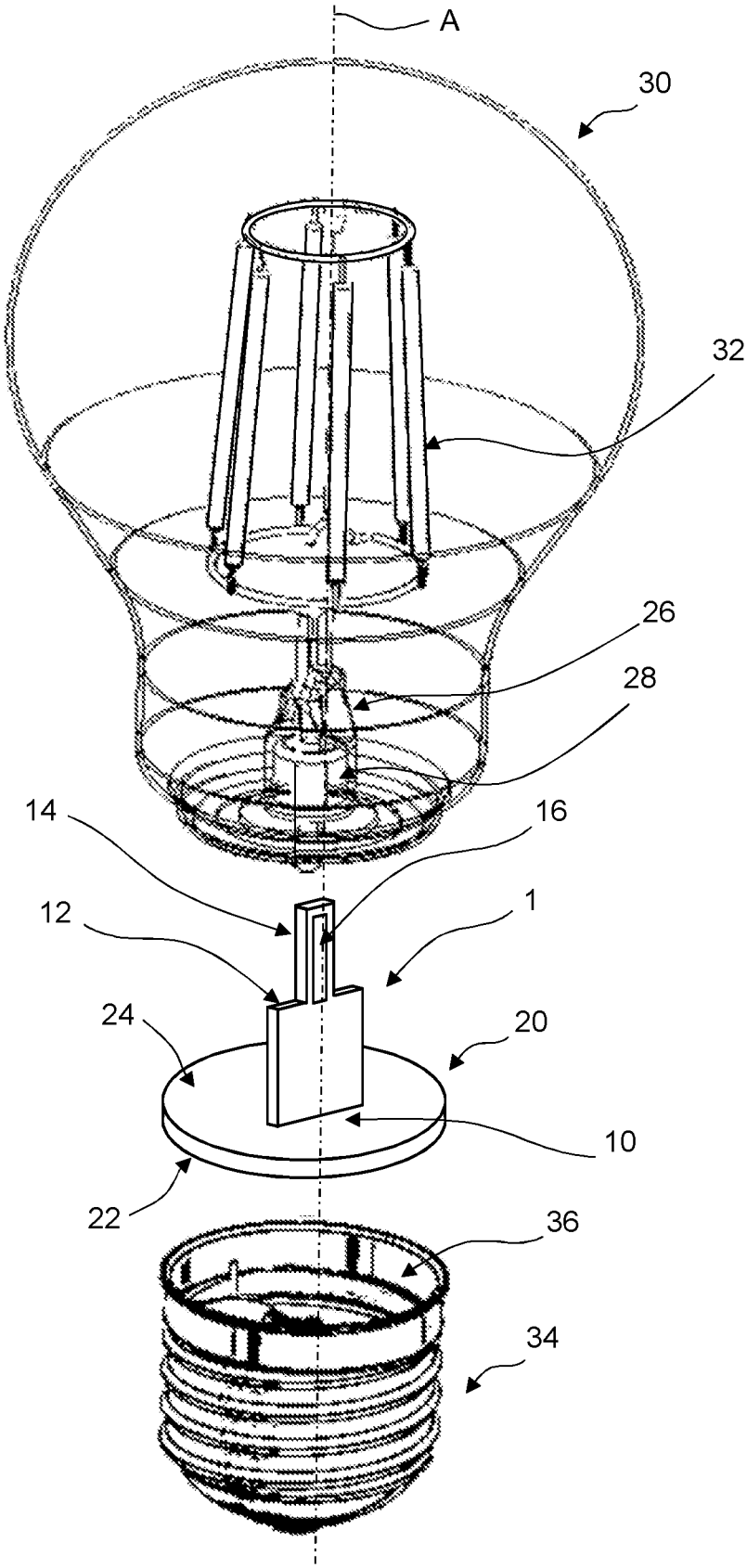
FIG. 6 a schematic depiction of a lamp comprising a driver, a connection module, a bulb, and a base.

An assembled lamp is shown in a schematic explosion view in FIG. 6, comprising a connection module 1, a driver 20, a bulb 30, and a base 34.

Accordingly, the lamp is depicted as a filament lamp, comprising a plurality of LED-based filaments 32 within the bulb 30 that are connected via a ring and having a structure to be arranged on the holder 26. The holder 26 is received in a bottom opening of the bulb 30, such that the bulb 30 is closed at its bottom by means of the holder 26.

Between the base 34, the holder 26, and the bulb 30 a connection module 1 is provided as described in view of the previous embodiments, which may be equally implemented in the lamp according to FIG. 6. Accordingly, the connection module 1 comprises the antenna 16 on an elongate region 14 extending from the second side 12 in the longitudinal direction A and perpendicular to both the first side 10 and second side 12 and the driver 20.

The driver 20 supports the connection module 1 at a second surface 24, e.g. by means of a clamp, slit, or insert, as described in the above.

In the assembled state, the driver 20 accommodating the connection module 1 is placed into a recess or cavity 36 of the base 34, wherein the first surface 22 faces a central surface of the base 34. As both the recess or cavity 36 and the driver 20 comprise an essentially circular shape, the positioning of the driver 20 into the recess or cavity 36 is facilitated and the space within the base 34 is efficiently used while at the same time the thermal performance may be improved.

Furthermore, the elongate region 14 of the connection module 1 is inserted into the recess 28 of the holder 26, such that the antenna 16 protrudes into the bulb 30 of the lamp. Since only the elongate region 14 extends beyond the base 34 and is housed within the bulb 30, no further adaptations are required, such that the provision of an extension adaptor ring may be omitted and the connection module 1 requires no further modifications. In addition, the integrated antenna 16 on the elongate region 14 ensures that a stabile and consistent radio frequency performance is provided, since the connectivity does not depend on a manual arrangement or attachment. Thereby, the design of the connection module 1 with the elongate region 14 and the integrated antenna 16 provides an improved wireless connectivity of the lamp while at the same time the manufacturing is facilitated and the production costs are reduced.

Although the invention has been illustrated and described in detail by the embodiments explained above, it is not limited to these embodiments. Other variations may be derived by the skilled person without leaving the scope of the attached claims.

Generally, "a" or "an" may be understood as singular or plural, in particular with the meaning "at least one", "one or more", etc., unless this is explicitly excluded, for example by the term "exactly one", etc.

In addition, numerical values may include the exact value as well as a usual tolerance interval, unless this is explicitly excluded.

Features shown in the embodiments, in particular in different embodiments, may be combined or substituted without leaving the scope of the invention.

The invention claimed is:

1. A connection module for a lamp having a bulb and a base, the connection module comprising:

a first side configured to be received by a driver in the base of the lamp;

a second side comprising an elongate region extending towards the bulb of the lamp, the elongate region having a width smaller than a length of the second side and the first side; and an antenna integrated in the connection module on an exterior of the elongate region such that no portion of the antenna is inside an interior of the elongate region;

wherein the elongate region and the antenna are each substantially planar in form.

2. The connection module according to claim 1, wherein the extending direction of the elongate region corresponds to a longitudinal direction of the lamp.

3. The connection module according to claim 1, wherein the antenna is linearly arranged on the exterior of the elongate region.

4. The connection module according to claim 1, wherein a ratio of the width of the elongate region and the length of at least one of the first side and the second side lies between 1:20 and 1:1.

5. The connection module according to claim 1, wherein a ratio of a length of the elongate region extending from the second side and a length of the connection module between the first side and the second side lies between 1:20 and 5:1 or 1:1.

6. The connection module according to claim 1, wherein the elongate region is dimensioned to be accommodated in a recess of a holder of the bulb.

7. The connection module according to claim 1, wherein the connection module is made of printed circuit board (PCB) material.

8. A driver for a lamp having a bulb and a base, the driver comprising:

a first surface configured to be received in a recess or cavity of the base and configured to face the base of the lamp;

a second surface comprising a connecting element or support; and the connection module according to claim 1, wherein the connection module is received by the connecting element or the support.

9. The driver according to claim 8, wherein the elongate region of the connection module is arranged perpendicular to the second surface.

10. The driver according to claim 8, wherein the first surface and the second surface at least one of:

extend in a radial direction of the lamp; and are arranged in parallel to a center surface of the recess or cavity of the base.

11. The driver according to claim 8, wherein the driver provides an electrical connection between the connection module and a contact pin or the base of the lamp.

12. A lamp comprising:

a bulb;

a base for providing an electrical contact with a lamp socket; and the connection module according to claim 1.

13. The lamp according to claim 12, wherein the base comprises a recess or cavity, and wherein the lamp further comprises a driver received in the recess or cavity of the base.

14. The lamp according to claim 12, wherein the bulb comprises a holder, and wherein the elongate region of the connection module is arranged at least partially within a recess of the holder.

15. The lamp according to claim 12, wherein the elongate region of the connection module extends beyond the base in a longitudinal direction of the lamp.

16. The connection module according to claim 1, wherein the antenna is integrated in the connection module on the exterior of the elongate region in a solderless manner.

17. The connection module according to claim 1, wherein the antenna is integrated in the connection module entirely on the exterior of the elongate region.

18. The connection module according to claim 1, wherein the antenna is printed or etched on the exterior of the elongate region.

19. The connection module according to claim 1, wherein the antenna is of smaller width than the exterior of the elongate region.

20. The connection module according to claim 1, wherein the connection module is substantially planar in form.

* * * * *